US006084241A

United States Patent [19]

Sitter

[11] Patent Number: 6,084,241

[45] Date of Patent: Jul. 4, 2000

[54] METHOD OF MANUFACTURING SEMICONDUCTOR DEVICES AND APPARATUS THEREFOR

[75] Inventor: Joseph W. Sitter, Tempe, Ariz.

[73] Assignee: Motorola, Inc., Schaumburg, Ill.

[21] Appl. No.: 09/087,699

[22] Filed: Jun. 1, 1998

[51] Int. Cl.[7] ..... H01J 49/04

[52] U.S. Cl. ..... 250/492.21; 250/423 R; 250/427

[58] Field of Search ..... 250/492.21, 423 R, 250/424, 427

[56] References Cited

U.S. PATENT DOCUMENTS

| | | | |
|---|---|---|---|
| 3,689,766 | 9/1972 | Freeman | 250/492.21 |
| 4,166,952 | 9/1979 | Colby et al. | 250/427 |
| 4,383,177 | 5/1983 | Keller et al. | 250/423 R |
| 4,412,153 | 10/1983 | Kalbfus et al. | 315/111.81 |
| 4,608,513 | 8/1986 | Thompson | 313/359.1 |
| 4,754,200 | 6/1988 | Plumb et al. | 315/111.81 |
| 4,760,262 | 7/1988 | Sampayan et al. | 250/423 R |
| 4,891,525 | 1/1990 | Frisa et al. | 250/423 R |
| 5,262,652 | 11/1993 | Bright et al. | 250/492.2 |
| 5,497,006 | 3/1996 | Sferlazzo et al. | 250/427 |
| 5,691,537 | 11/1997 | Chen et al. | 250/251 |
| 5,898,178 | 4/1999 | Bunker | 250/423 R |

FOREIGN PATENT DOCUMENTS 4227164 2/1994 Germany .

*Primary Examiner*—Kiet T. Nguyen
*Attorney, Agent, or Firm*—A. Kate Huffman

[57] ABSTRACT

A method of manufacturing a semiconductor device includes creating ions in a chamber (201), using the ions to generate sputtered material from a target (241, 242) in the chamber (201), creating other ions from the sputtered material in the chamber (201), extracting the other ions out of the chamber (201), and implanting the other ions into the wafer (111).

14 Claims, 3 Drawing Sheets

METHOD OF MANUFACTURING SEMICONDUCTOR DEVICES AND APPARATUS THEREFOR

BACKGROUND OF THE INVENTION

This invention relates, in general, to microelectronics, and more particularly, to methods of manufacturing semiconductor devices and apparati therefore.

Beryllium ions are typically implanted into semiconductor materials for making semiconductor devices. The beryllium ions are not generated by using a beryllium gas because of the high toxicity of beryllium. Instead, current methods for producing beryllium ions use complex chemical reactions. First, a silicon tetrafluoride gas molecule is ionized to liberate atomic and ionic fluorine atoms. Then, the atomic and ionic fluorine atoms chemically etch a beryllium oxide plate to liberate atomic beryllium atoms. Finally, the atomic beryllium atoms are ionized by electrons emitted from a hot filament.

However, this method of producing beryllium ions is inefficient because of the simultaneous production of many unusable by-product ions. The inefficiency of the beryllium ion production reduces the throughput of the ion implantation process.

Accordingly, a need exists for a more efficient method of producing beryllium ions in order to increase the throughput and productivity of the ion implantation process.

BRIEF DESCRIPTION OF THE DRAWINGS

For simplicity and clarity of illustration, elements in the drawings are not necessarily drawn to scale, and the same reference numerals in different figures denote the same elements.

DETAILED DESCRIPTION OF THE DRAWINGS

Figure 1:
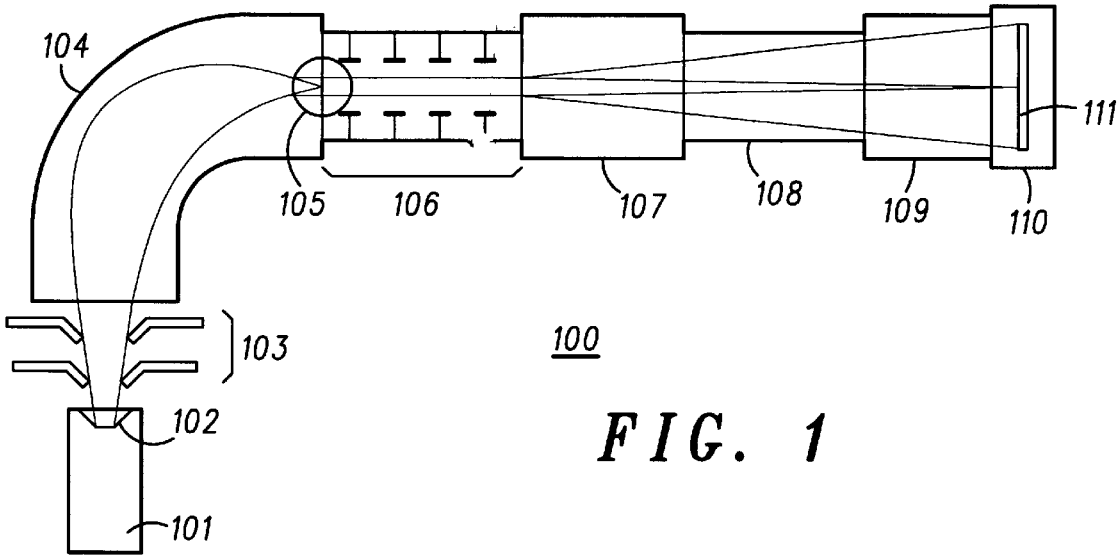
FIG. 1 illustrates a schematic view of an embodiment of an ion implanter in accordance with the present invention.

FIG. 1 illustrates a schematic view of an ion implanter 100. Implanter 100 is used to generate ions and to implant those ions into a semiconductor wafer to manufacture semiconductor devices. Implanter 100 includes an ion source 101 with an exit aperture 102. Ion source 101 generates the desired ions for subsequent implantation into a semiconductor wafer. Aperture 102 is coupled to an ion extractor 103 to extract or remove the ions from source 101.

Extractor 103 is coupled to an ion mass analyzer 104, which filters the desired ions from other by-product ions extracted from source 101. In one embodiment, analyzer 104 is a magnet, which does not produce a magnetic field within ion source 101. Analyzer 104 has an exit aperture 105 coupled to an acceleration column 106. Column 106 increases the velocity of the desired ions that exit analyzer 104 from aperture 105.

After being accelerated through column 106, the desired ion beam is directed, aimed, or focused into a small spot at a semiconductor wafer 111 by an ion beam focusing lens 107. Next, the ions are scanned or swept across wafer 111 by an ion beam scanner 108. Then, the ions pass through an electron suppresser 109, which eliminates the escape of recoil electrons from an ion implantation chamber to reduce errors in calculating the ion dosage of the implant. Finally, the ions are implanted into wafer 111 inside ion implantation chamber 110.

Figure 2:
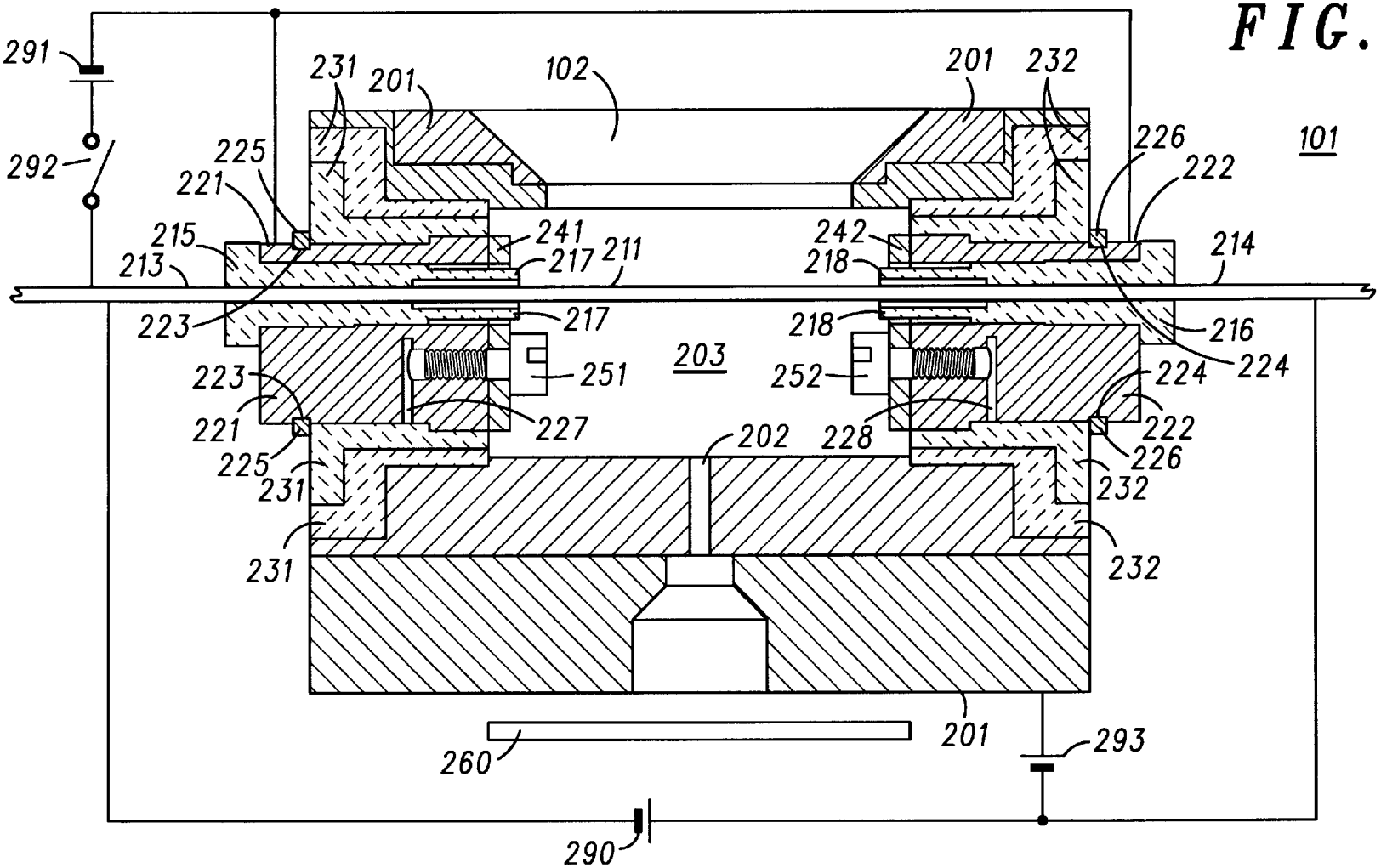
FIG. 2 illustrates a partial cross-sectional view of an embodiment of an ion source in the implanter of FIG. 1 in accordance with the present invention.

FIG. 2 illustrates a partial cross-sectional view of ion source 101 in ion implanter 100 of FIG. 1. Ion source 101 in FIG. 2 represents a modification of a Freeman-type hot cathode ion source. Freeman-type ion sources are known to those skilled in the art. However, as explained in more detail hereinafter, the concepts behind the modification are also applicable to other types of ion sources.

Ion source 101 includes, among other features, an arc or discharge chamber 201 having exit aperture 102. Aperture 102 is coupled to ion extractor 103 in FIG. 1. The walls of chamber 201 in FIG. 2 have a gas inlet port 202 and surround a cavity 203. The walls of chamber 201 are electrically conductive and serve as an anode for ion source 101.

Ion source 101 also includes a filament 211 located within cavity 203. Filament 211 serves as an electron source and a cathode for ion source 101. Filament 211 has opposite ends 213 and 214 extending through opposite walls of chamber 201. Filament 211 is supported by filament insulators 215 and 216, which electrically insulate filament 211 from the electrically conductive walls of chamber 201. More particularly, end 213 of filament 211 passes through a hole within insulator 215, and end 214 of filament 211 passes through a hole within insulator 216. Insulators 215 and 216 are preferably symmetrical with each other. Insulators 215 and 216 have ends 217 and 218, respectively, that point toward each other and that extend or protrude into cavity 203.

Target inserts 221 and 222 support insulators 215 and 216, respectively. More particularly, insulator 215 extends or passes through a hole within insert 221, and insulator 216 extends or passes through a hole within insert 222. Inserts 221 and 222 are preferably symmetrical with each other. Inserts 221 and 222 extend through opposite walls of chamber 201 and into cavity 203. Inserts 221 and 222 are preferably electrically conductive for reasons explained hereinafter. Insulators 215 and 216 electrically insulate filament 211 from inserts 221 and 222. Inserts 221 and 222 include grooves 223 and 224, respectively, in which snap rings 225 and 226, respectively, are located. Rings 225 and 226 keep inserts 221 and 222, respectively, at fixed positions within cavity 203. Inserts 221 and 222 also include vent ports 227 and 228, respectively, for reasons explained hereinafter.

Target insert insulators 231 and 232 support inserts 221 and 222, respectively. Insert 221 passes through a hole within insulator 231, and insert 222 passes through a hole within insulator 232. Insulators 231 and 232 extend through opposite walls of chamber 201 and into cavity 203. However, ends 217 and 218 of insulators 215 and 216 preferably extend into cavity 203 further than the ends of insulators 231 and 232 for reasons explained hereinafter. Insulators 231 and 232 are preferably symmetrical with each other. Insulators 231 and 232 electrically insulate inserts 221 and 222, respectively, from the electrically conductive walls of chamber 201. Several pins are used to maintain the relative orientations and positions of insulators 231 and 232 with respect to the walls of chamber 201 and with respect to inserts 221 and 222.

Sputtering targets 241 and 242 are supported by inserts 221 and 222, respectively, within cavity 203. Removable fastening devices 251 and 252 are inserted into holes within targets 241 and 242 and within inserts 221 and 222 to secure targets 241 and 242 to inserts 221 and 222, respectively. Targets 241 and 242 are located at opposite ends of filament 211.

As explained in more detail hereinafter, targets 241 and 242 supply sputtered material for generating ions to be implanted into wafer 111 of FIG. 1. Targets 241 and 242 are preferably comprised of the same electrically conductive material. In this preferred embodiment, targets 241 and 242 have the same electrical potential as inserts 221 and 222, respectively. Targets 241 and 242 should not be comprised of a dielectric material for reasons explained hereinafter.

Figure 3:
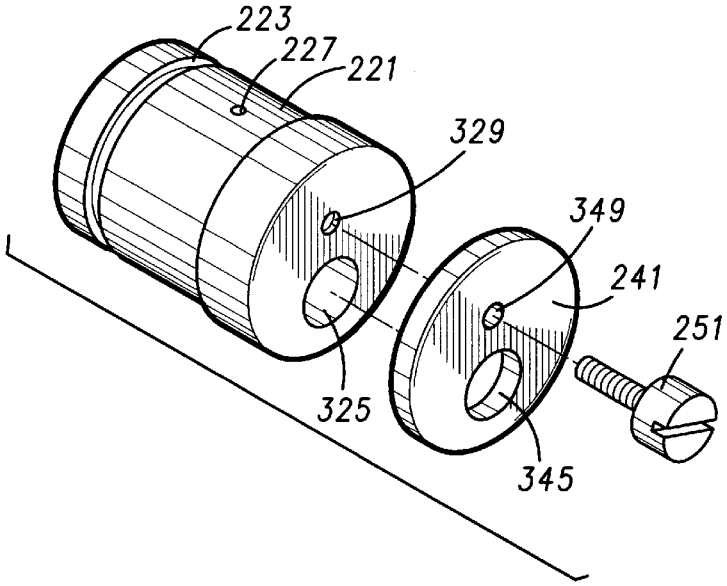
FIG. 3 illustrates an exploded isometric view of a portion of the ion source in FIG. 2 in accordance with the present invention.

Targets 241 and 242 are preferably symmetrical with each other. Targets 241 and 242 have holes that are aligned to and coaxial with holes in inserts 221 and 222. Ends 217 and 218 of insulators 215 and 216, respectively, protrude through these coaxial holes in cavity 203. Ends 217 and 218 preferably extend further into cavity 203 than targets 241 and 242 for reasons explained hereinafter. Fastening devices 251 and 252 extend into holes within inserts 221 and 222, and the holes are coupled to vent ports 227 and 228 of inserts 221 and 222 for reasons explained hereinafter. As an example, devices 251 and 252 can be screws. FIG. 3, explained hereinafter, illustrates an exploded perspective view of insert 221, target 241, and device 251.

A field generating device 260 is used create a magnetic or electrical field within cavity 203 for reasons explained hereinafter. As an example, device 260 can be a magnet. Device 260 is preferably located outside of cavity 203 so that device 260 is not exposed to an ion plasma generating within cavity 203.

Ion source 101 is electrically biased in the manner illustrated in FIG. 2. As explained earlier, the electrically conductive walls of chamber 201 serve as the anode for ion source 101 while filament 211 serves as the cathode for ion source 101. Typically, filament 211 is biased to a potential that is negative with reference to the walls of chamber 201. For example, filament 211 can be biased to a potential of approximately negative twenty-four to negative one hundred and fifty volts with respect to the walls of chamber 201. This difference in potential between the walls of chamber 201 and filament 211 is represented by a battery or direct current (d.c.) power source 293. During the operation of source 101, a current is passed through filament 211 from end 213 to end 214. Therefore, even though both ends of filament 211 are preferably at potential less than zero with respect to the walls of chamber 201, end 213 of filament 211 has a more negative potential than end 214 of filament 211. The voltage drop across filament 211 is represented by a battery or d.c. power source 290.

Also during the operation of source 101, inserts 221 and 222 are preferably electrically biased to the same potential, which also preferably electrically biases targets 241 and 242 to the same potential. Furthermore, inserts 221 and 222 and targets 241 and 242 are electrically biased to a more negative potential than end 213 of filament 211 by a battery or d.c. power source 291. As an example, the voltage source can be approximately one half volt to thirty volts d.c. and source a current of approximately one to five hundred milliamperes. A switch 292 couples power source 291 to end 213 of filament 211 in order to enable inserts 221 and 222 to be disconnected from filament 211 and to have a self-biased or floating potential. Alternatively, switch 292 can be located on the other side of power source 291 such that switch 292 couples power source 291 to inserts 221 and 222. Switch 292 should be capable of being actuated or operated from a remote location that is outside of a high voltage environment to provide high voltage isolation. When switch 292 is closed, targets 241 and 242 and inserts 221 and 222 are electrically biased to the most negative potential within cavity 203. A more detailed operation of ion source 101 is provided hereinafter with reference to FIG. 4.

FIG. 3 illustrates an exploded isometric view of a portion of ion source 101 in FIG. 2. Insert 221 is illustrated in FIG. 3 with groove 223 and vent port 227, which are also illustrated in FIG. 2. In FIG. 3, insert 221 is illustrated to further include a larger hole 325 and a smaller hole 329. Also illustrated in FIG. 3 is sputtering target 241. Target 241 includes a larger hole 345 and a smaller hole 349. Holes 325 and 345 are preferably the same size and coaxial with each other; holes 329 and 349 are also preferably the same size and coaxial with each other. Removable fastening device 251 is inserted into holes 349 and 329 to physically couple together insert 221 and target 241. End 217 of filament insulator 215 (FIG. 2) extends through holes 325 and 345 into cavity 203 (FIG. 2).

Coupling techniques other than those using device 251 and holes 349 and 329 can be used to secure target 241 to insert 221. For example, target 241 can be shaped like a cap to fit around an end of insert 221. As another alternative, insert 221 can serve as the target material. However, in the preferred embodiment, insert 221 is not the target material, and target 241 is used as the target material. This preferred embodiment provides a more cost effective method of target replacement.

Figure 4:
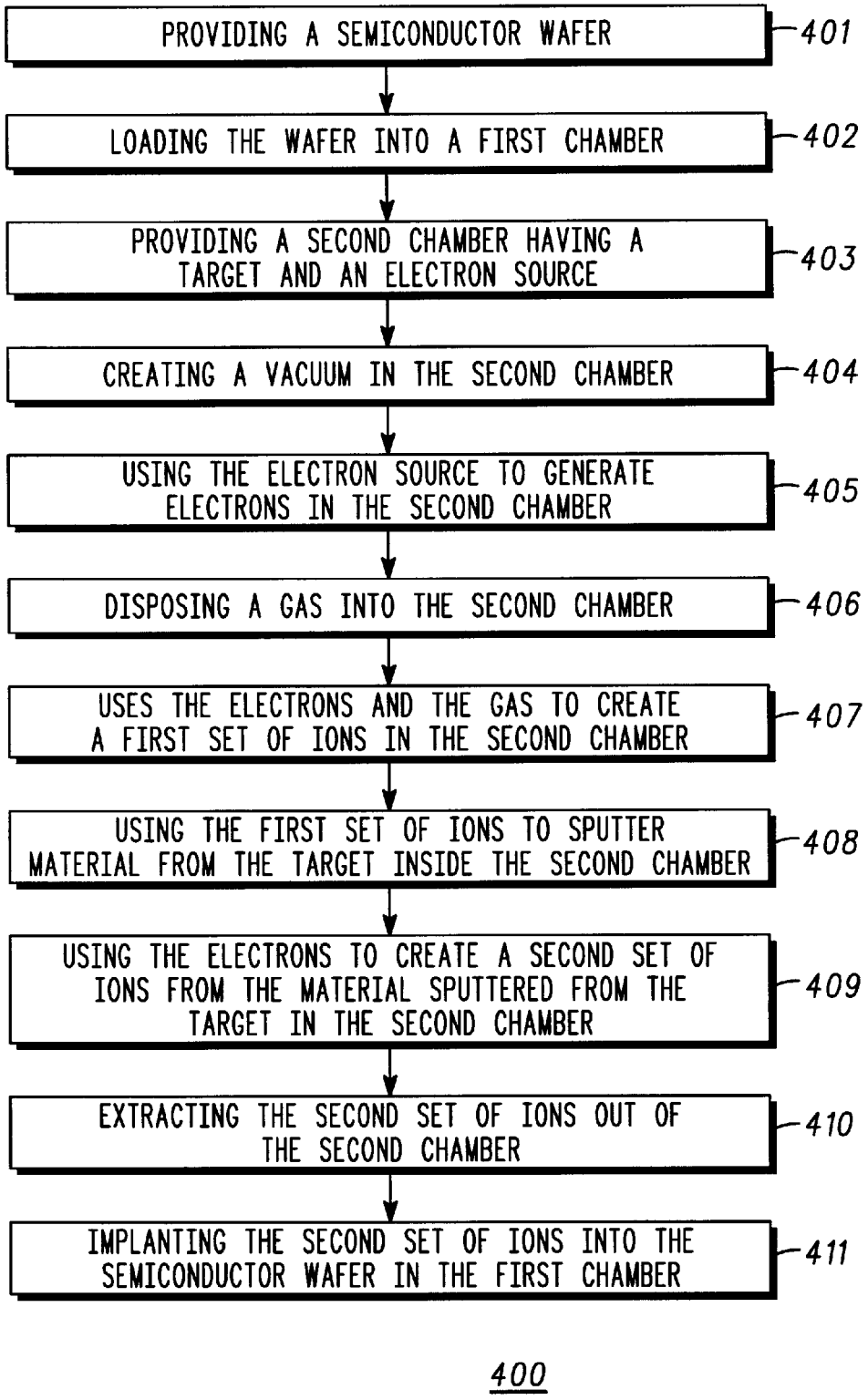
FIG. 4 outlines a method of manufacturing semiconductor devices in accordance with the present invention.

FIG. 4 outlines a method 400 of manufacturing semiconductor devices. Method 400 generally involves creating ions in a chamber, using the ions to generate sputtered material from a target in the chamber, creating other ions from the sputtered material, extracting the other ions out of the chamber, and implanting the other ions into a semiconductor wafer. Method 400 is described with reference to the preferred embodiment of implanting beryllium ions into the semiconductor wafer. Method 400 can be performed by, for example, implanter 100 of FIG. 1.

In more detail, method 400 includes, among other steps, providing a semiconductor wafer during a step 401. Method 400 continues with a step 402 for loading the wafer into a first chamber or ion implantation chamber such as, for example, chamber 110 in FIG. 1. Next, a step 403 provides a second chamber such as, for example, ion source 101 of FIGS. 1 and 2. The second chamber contains a target material such as, for example, targets 241 and 242 of FIG. 2, and also contains an electron source such as, for example, filament 211 of FIG. 2. In the preferred embodiment, the target material is electrically conductive and consists essentially of beryllium. The electron source is electrically biased to a potential that is higher or more positive than the a potential of the target material by, for example, closing switch 292 in FIG. 2.

Then, a step 404 in FIG. 4 creates a vacuum in the second chamber. In the preferred embodiment, creating the vacuum in cavity 203 also creates a vacuum in hole 329 (FIG. 3) by evacuating any gas or air in hole 329 through vent port 227 (FIGS. 2 and 3). In order for port 227 to enable the evacuation of the gas or air out of hole 329, insert 221 (FIG.

2) should not be sealed to insulator 231 (FIG. 2). Vent port 228 (FIG. 2) serves a similar purpose as vent port 227.

Method 400 in FIG. 4 continues with a step 405 for generating electrons in the second chamber. In the preferred embodiment, a current is passed through filament 211 (FIG. 2), which emits electrons within cavity 203 (FIG. 2). As an example, a current of approximately ten to two hundred amperes with an approximate one quarter volt to six volt drop across filament 211 can be used.

Subsequently, a step 406 in FIG. 4 disposes a gas into the second chamber. As an example, the gas may be injected into cavity 203 (FIG. 2) through gas inlet port 202 (FIG. 2). For reasons explained hereinafter, the gas is preferably an inert or noble gas such as, for example, argon. As used herein, the term gas includes gases, vapors, and the like. Next, a step 407 in FIG. 4 uses the electrons to create a first set of ions in the second chamber. Step 407 creates the first set of ions from a source other than the target material. Preferably, the gas of step 406 serves as the source material for the first set of ions. The electrons collide into the gas molecules to ionize the gas molecules by stripping valence electrons from the gas molecules. To increase the probability that an electron will collide into a gas molecule, the electrons are emitted from filament 211 (FIG. 2) into a magnetic field, which increases the length of the mean free path of the electrons. The increase in the mean free path length increases the ionization efficiency of step 407. The magnetic field within cavity 203 (FIG. 2) is created by field generating device 260 (FIG. 2) preferably before the gas is disposed into cavity 203 during step 406. In the preferred embodiment, the electrons ionize the argon gas molecules into positively charged argon ions.

Then, a step 408 in FIG. 4 uses the first set of ions to sputter material from the target inside the second chamber. In the preferred embodiment, the positively charged argon ions sputter beryllium atoms off of beryllium targets 241 and 242 (FIG. 2). The argon ions are devoid of or do not chemically etch the target material because the argon ions are inert. Therefore, step 408 preferably does not use a reactive ion etching or other chemical etching process. Instead, step 408 preferably only uses a physically sputtering process to remove the material from the target. The positively charged argon ions are attracted to targets 241 and 242 because the targets are electrically biased to a negative potential relative to any portion of filament 211 (FIG. 2). The potential of targets 241 and 242 is preferably the most negative potential within cavity 203. Ends 217 and 218 of insulators 215 and 216, respectively, protrude further into cavity 203 to protect filament 211 from a build-up of sputtered target material that could short circuit targets 241 and 242 to filament 211.

Method 400 in FIG. 4 continues with a step 409 for using the electrons to create a second set of ions from the material sputtered from the target in the second chamber. In the preferred embodiment, the electrons emitted from filament 211 (FIG. 2) also collide into the beryllium atoms sputtered off of targets 241 and 242 (FIG. 2) to ionize the beryllium atoms into positively charged beryllium ions in cavity 203 (FIG. 2). Next, a step 410 extracts the second set of ions out of the second chamber. In the preferred embodiment, the positively charged beryllium ions are removed or extracted out of ion source 101 (FIGS. 1 and 2) through exit aperture 102 (FIGS. 1 and 2) by ion extractor 103 (FIG. 1).

Then, the second set of ions pass through other portions of ion implanter 100 (FIG. 1) and are subsequently implanted into the semiconductor wafer in the first chamber during a step 411 of method 400. In the preferred embodiment, the positively charged beryllium ions are implanted into semiconductor wafer 111 (FIG. 1) in ion implantation chamber 110 (FIG. 1). While the first set of ions may also be extracted from the first chamber along with the second set of ions during step 410, the first set of ions are not implanted into the wafer during step 411. A filter prevents the first set of ions from reaching the wafer. In the preferred embodiment, ion mass analyzer 104 does not permit the argon ions to pass through to acceleration column 106, but does permit the desired beryllium ions to pass through to acceleration column 106.

If a different ion is to be implanted, then switch 292 in FIG. 2 can be opened to keep inserts 221 and 222 and targets 241 and 242 at a floating potential. In this embodiment, inserts 221 and 222 and targets 241 and 242 are self-biased and serve as repellers to push away or repel the ions towards the center of cavity 203 and compress the density of the ions. Thus, with switch 292 open, targets 241 and 242 will not be sputtered.

Figure 5:
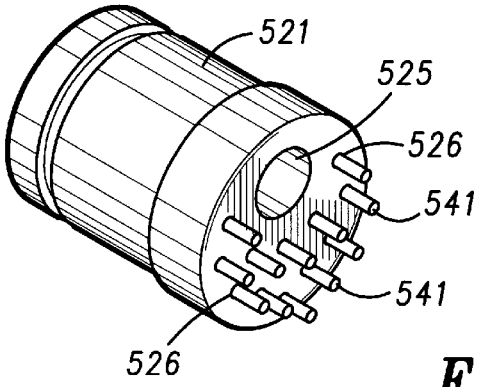
FIG. 5 illustrates an isometric view of a different embodiment of the portion of the ion source illustrated in FIG. 3 in accordance with the present invention.

FIG. 5 illustrates an isometric view of a different embodiment of the portion of the ion source illustrated in FIG. 3. A target insert 521 is similar to insert 221 of FIG. 3. Insert 521 has a large hole 525 that is similar to hole 325 of insert 221 in FIG. 3. However, unlike insert 221 of FIG. 3, insert 521 has a plurality of smaller holes 526. A plurality target posts, pegs, or pins 541 are disposed or inserted into holes 526 and extend out of holes 526. Pins 541 replace target 241 of FIG. 3. Pins 541 in FIG. 5 concentrate the electrostatic charge within cavity 203 (FIG. 2) and attract the positively charged argon ions to increase the sputtering effect compared to that of target 241 in FIG. 3.

Therefore, an improved method of manufacturing semiconductor devices and apparatus therefor is provided to overcome the disadvantages of the prior art. For example, the long ends of the filament insulator extend the useful lifetime of the ion source assembly by protecting the filament from a build-up of sputtered target material that could short circuit the targets to the filament.

Furthermore, the method and apparatus improve the efficiency of generating metallic ions for implantation into semiconductor wafers. The method also eliminates the wasteful production of many by-product ions associated with the prior art methods. Examples of the prior art by-products include silicon ions and fluorine ions. By eliminating these by-products, the method disclosed herein preferably only uses a physical sputtering process to remove atoms from the target material and does not use a chemical etching process to remove atoms from the target material. Furthermore, by eliminating the by-product ions, a significantly higher ion beam current can be achieved, and a high ion beam current will reduce the cycle time required for implanting a semiconductor wafer.

Moreover, the method and apparatus disclosed herein also improve the lifetime of the filament in a Freeman-type ion source because the filament is no longer the most negatively biased feature within the ion source, which prevents the positively charged ions from bombarding and sputtering material off of the filament. This lifetime extension reduces the amount of maintenance required for an ion implanter and increases the throughput of the ion implantation process.

While the invention has been particularly shown and described mainly with reference to preferred embodiments, it will be understood by those skilled in the art that changes in form and detail may be made without departing from the spirit and scope of the invention. For instance, the numerous details set forth herein such as, for example, the material compositions of the gas and the target are provided to facilitate the understanding of the present invention and are not provided to limit the scope of the invention. For example, while inserts 221 and 222 in FIG. 2 are electrically conductive in the preferred embodiment, inserts 221 and 222 can alternatively be electrically insulative while electrical connections extending through inserts 221 and 222 provide the appropriate electrical bias to targets 241 and 242.

As another example, targets 241 and 242 can be comprised of any metal that needs to be implanted, but the metal should have a relatively high deformation and melting temperature to be able to withstand the high temperatures of the sputtering process. Titanium or tungsten are examples of suitable alternatives to beryllium. However, to provide a wider range of suitable materials, heatsinks can be coupled to targets 241 and 242 and inserts 221 and 222 in order to reduce the temperature of targets 241 and 242 and inserts 221 and 222. For example, inner portions of inserts 221 and 222 can be hollowed out, and a coolant can be circulated throughout the hollowed passages within inserts 221 and 222 to remove heat from inserts 221 and 222 and from targets 241 and 242. In this alternative, metals with lower melting temperatures can be used for targets 241 and 242.

In another alternative to the embodiment illustrated in FIG. 2, insert 221 and target 241 can be used while target 242 is removed and while insert 222 is not electrically shorted to insert 221. In this embodiment, insert 222 is preferably electrically floating to serve as a repeller in order to repel or push the electrons, argon ions, and beryllium ions away from insert 222. Therefore, insert 222 can increase the density of the ion and electron cloud within cavity 203 and increases the efficiency of ion generation.

In yet another alternative to the embodiment illustrated in FIG. 2, targets 241 and 242 can be comprised of different metals such as, for example, beryllium and tungsten, respectively. In this embodiment, target 241 and insert 221 can be coupled to end 213 of filament 211 by switch 292 while target 242 and insert 222 are coupled to end 213 of filament 211 by a different or second switch. When beryllium ions are to be implanted, the second switch is opened, and switch 292 is closed. Therefore, target 242 serves as a repeller and is not sputtered, but target 241 is sputtered by the argon ions. When tungsten ions are to implanted, then the second switch is closed, and switch 292 is opened.

In still another alternative to the embodiment in FIG. 2, when targets 241 and 242 are not to be sputtered, targets 241 and 242 can be electrically biased to a potential that is more positive than the most negative potential within cavity 203. Similarly, if target 241 is to be sputtered while target 242 is not to be sputtered, insert 222 and target 242 can be electrically biased to a positive potential relative to the potential of target 241 and insert 221 such that the positively charged argon ions are more attracted to target 241 than target 242. As an example, insert 222 and target 242 can be electrically shorted to either end of filament 211, or insert 222 and target 242 can be electrically shorted to the walls of chamber 201. However, in this alternative embodiment, insert 222 and target 242 do not serve as repellers and do not provide the advantage of increasing the density of the ion plasma within cavity 203.

Other alternatives include positioning the electron source, sputtering targets, and repellers at different locations within the ion source. Similarly, the concepts disclosed herein can also be applied to other types of ion sources. For example, the ion source disclosed in U.S. Pat. No. 5,497,006, issued on Mar. 5, 1996, can be modified by converting the repeller into an electrically conductive sputtering target. Alternatively, a separate sputtering target can be added to that ion source while the repeller remains active. In either case, the sputtering target should be electrically biased to a more negative potential than the electron source or hot plate.

Accordingly, the disclosure of the present invention is not intended to be limiting. Instead, the disclosure of the present invention is intended to be illustrative of the scope of the invention, which is set forth in the following claims.

What is claimed is:

1. A method of manufacturing a semiconductor device comprising:

providing a wafer;

providing a chamber with a filament having a first material located at a first end of the filament and providing a different material at a second end of the filament, the second end opposite the first end of the filament;

creating ions in the chamber;

electrically biasing the first material to a negative potential relative to all portions of the filament to attract the ions;

electrically biasing the different material to a positive potential relative to the first material such that the ions are more attracted to the first material than the different material;

using the ions to generate a sputtered material from the first material in the chamber wherein the ions are devoid of reactive ion etching the first material;

creating other ions from the sputtered material in the chamber;

extracting the other ions out of the chamber; and implanting the other ions into the wafer.

2. The method of claim 1 wherein providing the chamber further comprises providing an electrically conductive layer for the material.

3. The method of claim 1 wherein creating the ions further comprises creating positively charged ions for the ions wherein the first potential is less than zero volts.

4. The method of claim 1 wherein creating the ions includes creating the ions from a source other than the material.

5. The method of claim 1 wherein creating the ions further comprises creating inert ions for the ions.

6. The method of claim 1 wherein electrically biasing the different material further comprises electrically biasing the different material to repel the ions away from the different material.

7. The method of claim 1 further comprising:

providing an ion repeller in a portion of the chamber; and electrically biasing the ion repeller to repel the ions and the other ions away from the portion of the chamber, wherein the using step further comprises electrically biasing the material to attract the ions towards the material.

8. The method of claim 1 wherein the implanting step further comprises preventing the ions from being implanted into the wafer.

9. A method of manufacturing a semiconductor device comprising:

providing a semiconductor wafer;

loading the semiconductor wafer into a first chamber;

providing a second chamber having a target;

providing a filament to provide electrons in the second chamber;

electrically biasing a first end of the filament to a first negative potential;

electrically biasing a second end of the filament to a positive potential with reference to the first negative potential;

electrically biasing the target to a second negative potential with reference to the first negative potential;

disposing an inert gas into the second chamber; using the electrons to create first ions in the second chamber from the inert gas;

using the first ions to sputter a material from the target in the second chamber;

using the electrons to create second ions from the material in the second chamber;

extracting the second ions out of the second chamber; and implanting the second ions into the semiconductor wafer in the first chamber.

10. The method of claim 9 further comprising:

providing a target insert in the second chamber to support the target and electrically biased to the second negative potential;

providing a first insulator in the second chamber to support the target insert;

providing a second insulator in the second chamber to support the filament within the target insert and to electrically isolate the filament from the target insert and the target wherein the second insulator extends into the second chamber further than the target, the target insert, and the first insulator; and circulating a coolant through the target insert to remove heat from the target insert.

11. The method of claim 10 wherein the generating step further comprises emitting the electrons into a magnetic field before using the electrons to create the first ions, wherein providing the target insert further comprises providing the target insert with a hole and a vent port coupled to the hole, wherein providing the second chamber further comprises providing the target with a hole coaxial with the hole of the target insert, and further comprising:

inserting a removable fastener in the hole to couple the target and the target insert together; and creating a vacuum in the second chamber before the generating step wherein a vacuum is simultaneously created in the hole through the vent port.

12. The method of claim 9 wherein providing the second chamber further comprises providing the target comprised of beryllium wherein the target is electrically conductive, wherein the disposing step further comprises providing argon for the inert gas, wherein using the electrons to create the second ions further comprises creating positively charged ions for the second ions, and wherein the implanting step further comprises preventing the first ions from being implanted into the semiconductor wafer.

13. An apparatus for manufacturing semiconductor devices comprising:

a chamber having an exit aperture;

an electron source having a filament and located in the chamber;

a target inside the chamber to supply sputtered material for generating ions wherein the target is electrically biased to a more negative potential than the electron source;

a target insert in the chamber, electrically biased to the more negative potential, and supporting the target wherein the target insert has a hole and a vent port coupled to the hole and wherein the target has a hole coaxial with the hole of the target insert;

a first insulator in the chamber and electrically isolating the target insert and the target from the chamber wherein the target insert extends through the first insulator;

a second insulator in the chamber, supporting the filament, and electrically isolating the filament from the target insert and the target wherein the filament and the second insulator extend through the target insert and wherein the second insulator extends further into the chamber than the target insert, the target, and the first insulator;

a removable fastener in the holes of the target and the target insert to couple the target to the target insert wherein the vent port in the target insert enables evacuation of gas from the hole in the target insert;

an ion extractor coupled to the exit aperture; and an implantation chamber coupled to the ion extractor.

14. The apparatus of claim 13 wherein the target further comprises a plurality of pegs.

* * * * *